US007165650B2

(12) United States Patent
Korchagin et al.

(10) Patent No.: US 7,165,650 B2
(45) Date of Patent: Jan. 23, 2007

(54) HIGH-RISE, FIRE-FIGHTING, RESCUE AND CONSTRUCTION EQUIPMENT

(76) Inventors: Pavel V. Korchagin, Apt. 99, House 39 Dubninskaya Street, Moscow 127474 (RU); Ivan P. Korchagin, Apt. 81, House 30, Building 1 Beskudnikovsky Boulevard, Moscow 127474 (RU); Vladimir A. Bararushkin, 2375 E. 16 St., 2nd Floor, Brooklyn, NY (US) 11229; Leonid M. Feoktistov, Apt. 44, House 18, Building 3 Ostrovityanov Street, Moscow 117321 (RU); Igor R. Kazimov, Apt. 139, House 12 Milashenkov Street, Moscow 127322 (RU)

( * ) Notice: Subject to any disclaimer, the term of this patent is extended or adjusted under 35 U.S.C. 154(b) by 605 days.

(21) Appl. No.: 10/663,260

(22) Filed: Sep. 16, 2003

(65) Prior Publication Data

US 2005/0006177 A1 Jan. 13, 2005

Related U.S. Application Data

(63) Continuation-in-part of application No. 10/431,946, filed on May 8, 2003, which is a continuation-in-part of application No. 10/334,023, filed on Dec. 30, 2002, now Pat. No. 7,036,630, which is a continuation-in-part of application No. 10/205,981, filed on Jul. 26, 2002, now Pat. No. 7,096,996.

(51) Int. Cl.
*B66B 9/00* (2006.01)

(52) U.S. Cl. ..... 182/82; 182/37; 187/239

(58) Field of Classification Search ..... 182/82, 182/142, 37; 187/239
See application file for complete search history.

(56) References Cited

U.S. PATENT DOCUMENTS

| | | | | |
|---|---|---|---|---|
| 4,018,306 | A * | 4/1977 | Lyons | 182/148 |
| 4,042,066 | A * | 8/1977 | Noone | 182/142 |
| 4,098,371 | A * | 7/1978 | Cox | 182/2.7 |
| 4,865,155 | A * | 9/1989 | Montaigne et al. | 182/14 |
| 5,113,969 | A * | 5/1992 | Drolet et al. | 182/2.11 |
| 5,582,467 | A * | 12/1996 | Drolet et al. | 299/33 |
| 5,845,739 | A * | 12/1998 | Ohtsuki | 182/37 |

FOREIGN PATENT DOCUMENTS

DE 3939762 A1 * 6/1991

* cited by examiner

*Primary Examiner*—Alvin Chin-Shue
(74) *Attorney, Agent, or Firm*—Steven E. Kahm; Nikolai & Mersereau, P.A.

(57) ABSTRACT

An elevator system for traveling on a rail attached to the outside of a high-rise building. One elevator has a telescopic arm attached for reaching any position on or above the building. The telescopic arm consists of two parts, which are interconnected with a pivoting mechanism. The telescopic arm has a pivot at its end attached to a cramp, by a vertical rotating mechanism. The cramp is pivoted to an outside platform with a barrier, a cabin is hung from the platform and can make a full rotation. The elevator portion has a passenger compartment with sliding doors and a vertical aperture with a staircase connecting with an autonomous rescue elevator.

11 Claims, 10 Drawing Sheets

HIGH-RISE, FIRE-FIGHTING, RESCUE AND CONSTRUCTION EQUIPMENT

This application is a continuation-in-part of Ser. No. 10/431,946 filed on May 8, 2003, which is a continuation-in-part of Ser. No. 10/334,023 filed on Dec. 30, 2002, now U.S. Pat. No. 7,036,630 which is a continuation-in-part of Ser. No. 10/205,981 filed on Jul. 26, 2002 now U.S. Pat. No. 7,096,996.

BACKGROUND OF THE INVENTION

1. Field of the Invention

This invention relates to elevating facilities for high-rise buildings and, specifically—to combinations of elevator & crane systems running on a rail attached to the outside of a building. The facilities may have an elevator portion—for traveling vertically up and down, and a crane portion—to extend a telescopic arm to a desired location and to support a passenger cabin for rescue operations. The crane portion can also have a fire-fighting equipment—to access all parts of a building. The invention can be used for fire-fighting & rescue of people and equipment, and can also be used for construction, repairs and maintenance of high-rise structures.

2. Description of the Related Art

Currently, the prototype application for the USA patent "High-Rise Fire-Fighting, Rescue and Construction Equipment" (Ser. No. 10/431,946, filing date—May 08, 2003), comprises a device having and an elevator portion—for traveling vertically up and down outside of a building, and a crane portion—to extend an arm to a desired location. The crane portion can support a passenger cabin for fire rescue; it can also have fire-fighting equipment for an access to all parts of a building. The crane portion can also haul building materials to any part of a building under construction and can be used for window washing or other maintenance activities on the building. The prototype structure doesn't allow to evacuate people from the cabin directly to the elevator portion and to autonomous rescue elevator (and back), and also, from the elevator portion to the autonomous rescue elevator (and back).

SUMMARY OF THE INVENTION

The invention utilizes a telescopic arm—to access to a desired location. The telescopic arm consists of two parts, which are interconnected with the help of a pivoting mechanism. The telescopic arm has a pivot at its end, attached to a cramp, with the help of a vertical rotating mechanism. The cramp, also, is pivoted, with the help of vertical rotating mechanisms, to an outside platform supplied with a barrier; a cabin is hanged onto the platform. The cabin itself can rotate 360 around its vertical axis—with the help of a rotating mechanism.

The elevator portion has a passenger compartment with sliding doors—for connection with the cabin, and a vertical aperture with a staircase, consisting of two parts—for connection with a rescue elevator.

For safety reasons, elastic profile is used for elevator portion contact surface and for upper surface of an autonomous rescue elevator. Supporting elements of an elastic profile are provided below contacting surfaces of the elevator portion and on the autonomous rescue elevator.

For constant fuelling and liquids supply, the cabin, the elevator portion and the autonomous rescue elevator are provided with compartments for keeping anti-fire foam and other liquids and hoses.

For more operative control, a passenger compartment of the elevator portion is provided with an additional control panel.

For a better contact between elastic tires and working surfaces of an H-shaped rail, the working surfaces have guiding slots.

OBJECTS OF THE INVENTION

It is an object of the invention to provide a telescopic arm consisting of two parts, interconnected with a pivoting mechanism; the telescopic arm, being pivoted to a cramp with a vertical rotating mechanism; the cramp being pivoted to an outside platform supplied with a barrier to which a cabin is hanged to capable to make full rotation around its vertical axis.

It is an object of the invention to provide the elevator portion with a passenger compartment with sliding doors, and a vertical aperture with a staircase, consisting of two parts—on elevator portion and on autonomous rescue elevator,—leading to an autonomous rescue elevator; this elevator having a hatch under the vertical aperture.

It is an object of the invention to provide, for safety purpose, elastic elements on a contact cabin platform and on supporting elements of an autonomous rescue elevator.

It is an object of the invention to provide compartments, in a cabin, an elevator portion and in an autonomous rescue elevator,—for permanent additional fuelling and liquids.

It is an object of the invention to provide additional control panel in a passenger compartment.

It is an object of the invention to provide guiding slots in working surfaces of an H-shaped rail for base tires.

Other objects, advantages and novel features of the present invention will become apparent from the following description of the preferred embodiments when considered in conjunction with the accompanying drawings.

DESCRIPTION OF THE PREFERRED EMBODIMENTS

As it was explained and described in the previous application for the USA patent "High-Rise Fire-Fighting, Rescue and Construction Equipment" (Ser. No. 10/431,946, filing date—May 08, 2003), the invention contained an elevator portion for traveling vertically up and down on the outside of a building, and a crane portion for extending an arm to a desired location on the building. The crane portion can support a passenger cabin for fire rescue. It can also have fire-fighting equipment for an access to all parts of a building.

This system doesn't allow to transfer or evacuate people directly from a cabin to an elevator portion and to an autonomous rescue elevator (and back), and from an elevator portion to the autonomous rescue elevator (and back).

Figure 3:
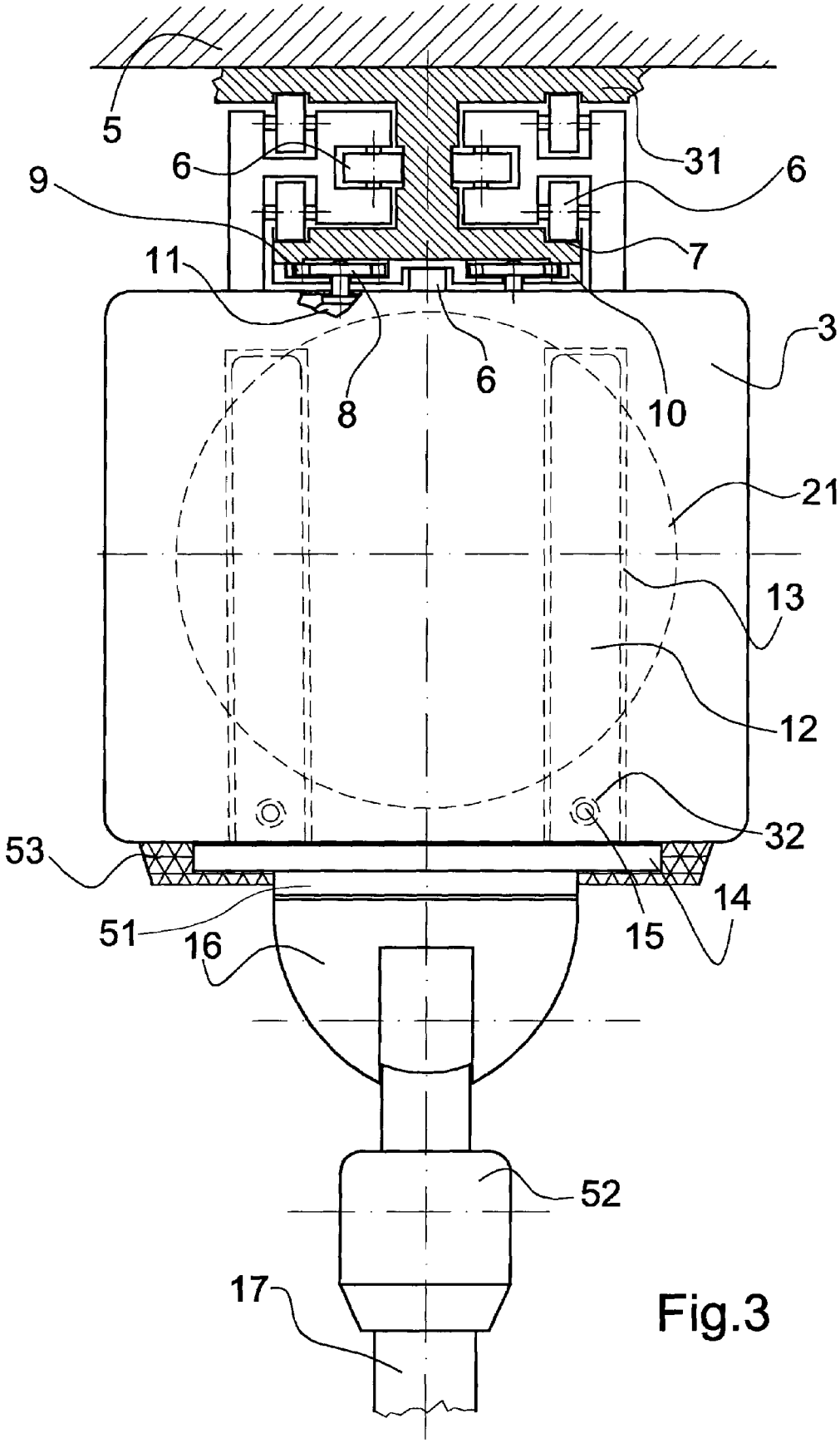
FIG. 3 shows a top view of the elevator portion installed on an H-shaped rail.
Figure 4:
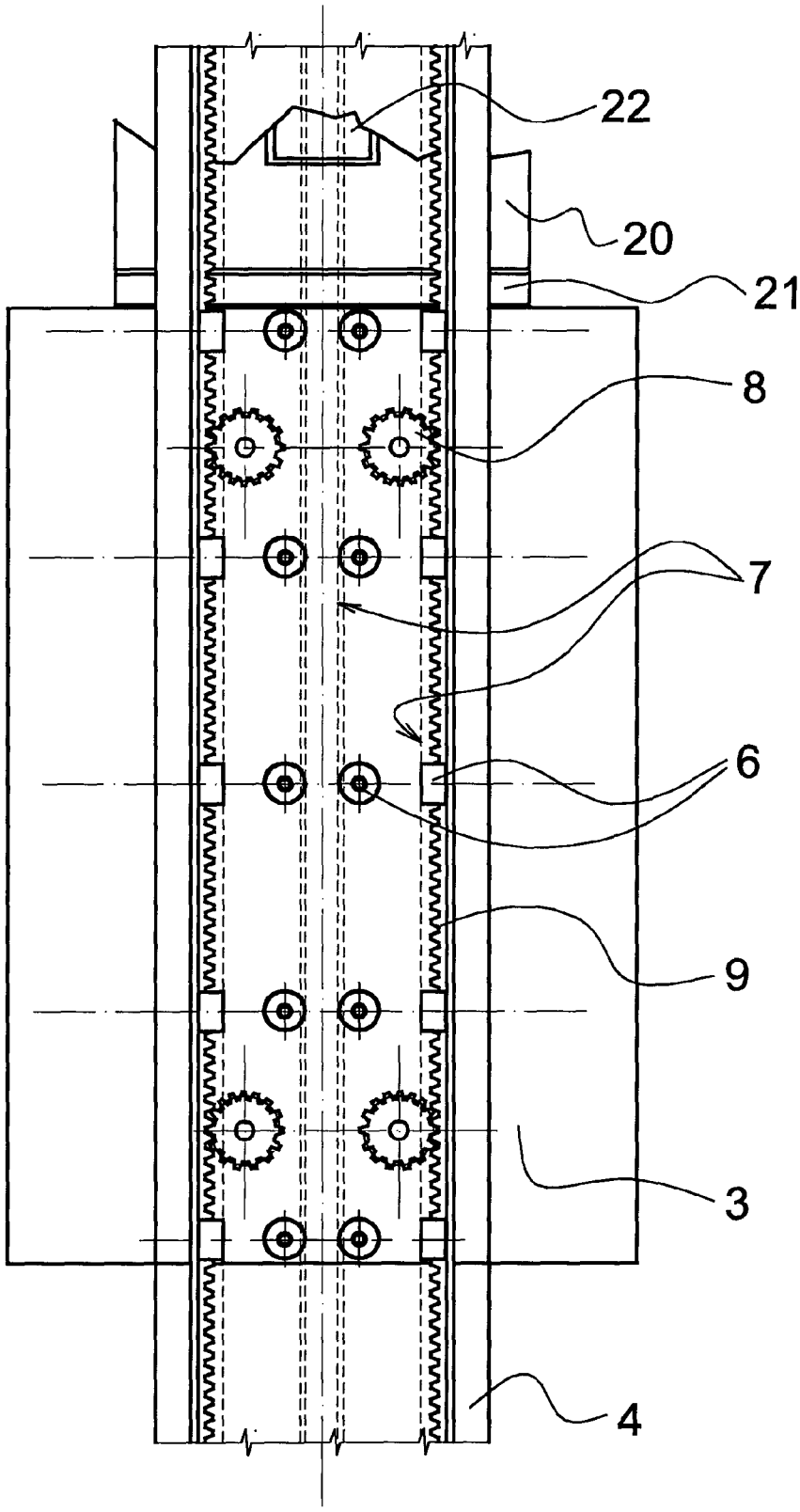
FIG. 4 shows a front view of the elevator portion installed on an H-shaped rail.
Figure 5:
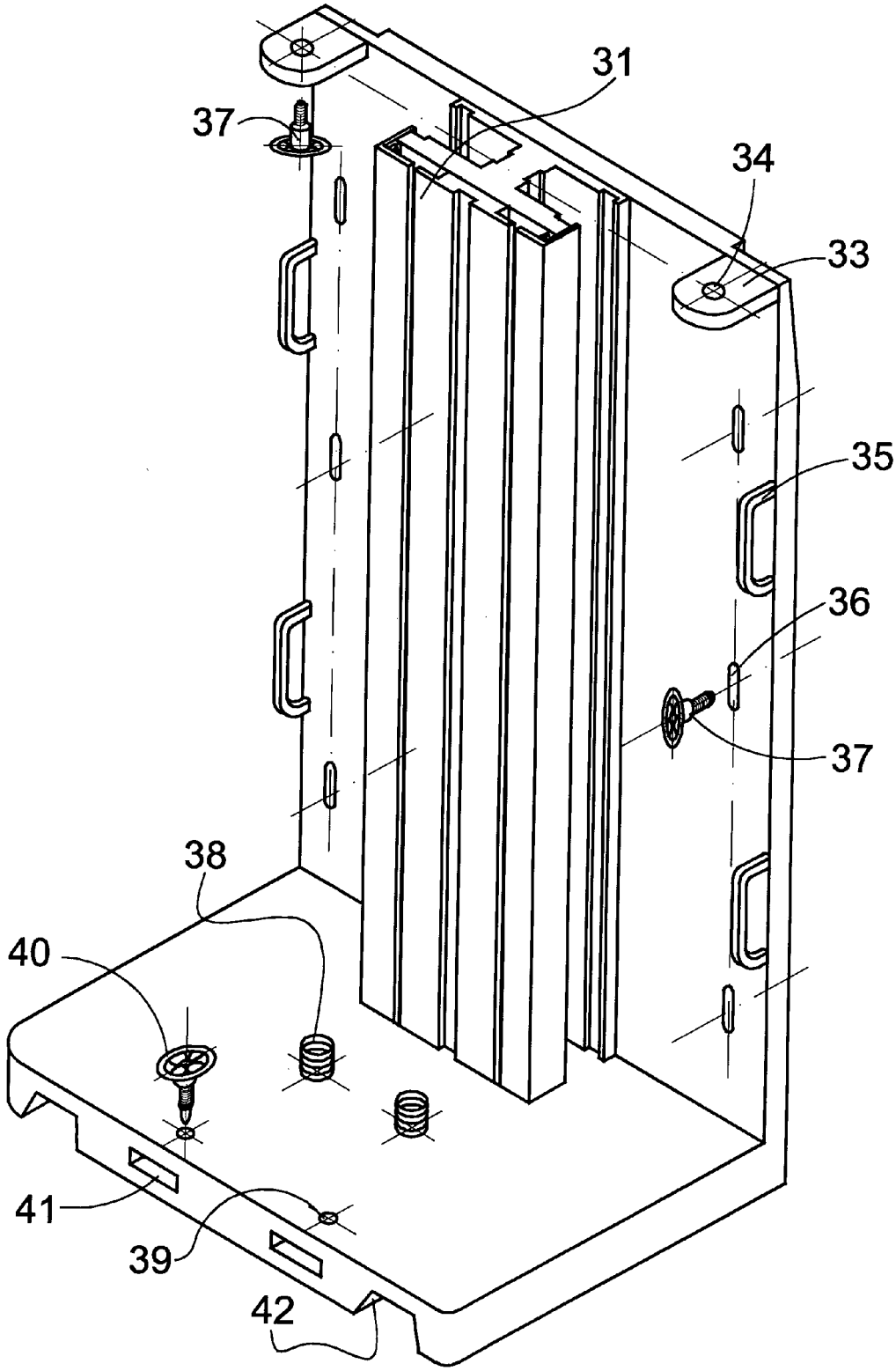
FIG. 5 shows a perspective view of the attachment section of an H-shaped rail.
Figure 8:
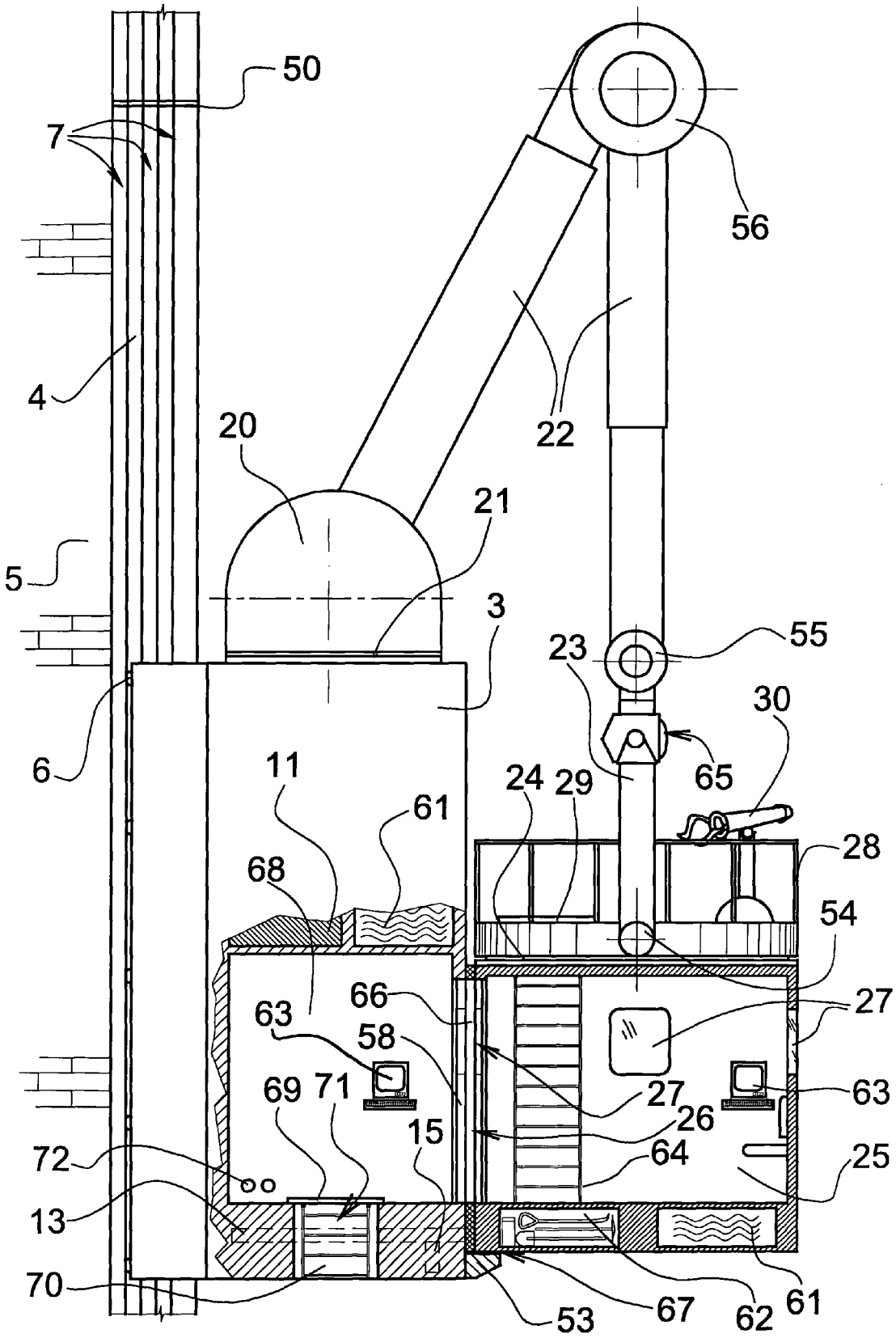
FIG. 8 shows a side view of the elevator portion being connected with the cabin.
Figure 9:
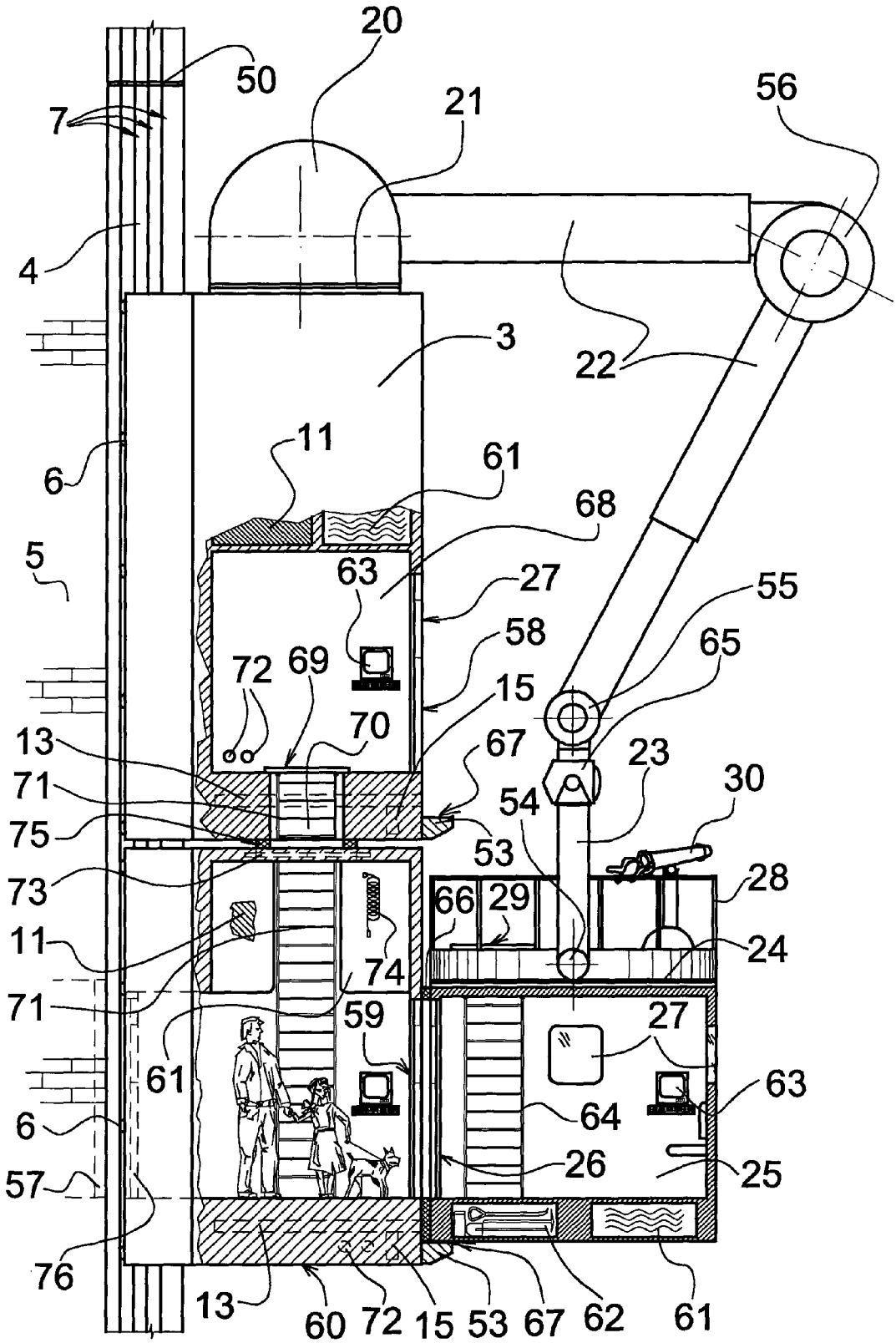
FIG. 9 shows a side view of the elevator portion being connected with the autonomous rescue elevator.

As shown in FIGS. 8 and 9, the invention provides a telescopic arm 22 consisting of two parts which are connected with a pivoting mechanism 56. The telescopic arm 22 at its end is pivoted to a cramp 23 with a vertical rotating mechanism 55. The cramp, also, is pivoted with vertical rotating mechanisms 54 to an outside platform 28 provided with a barrier, on which a cabin 25 is hanged to. The cabin itself can make a full rotation around its vertical axis with the help of a rotating mechanism 24. The elevator portion 3 has a passenger compartment 68 with sliding doors 58—for communication with the cabin 25, and a vertical aperture 70 with a staircase 71—for communication with an autonomous rescue elevator 60. As shown in FIGS. 3 and 4, the elevator portion 3, through its elastic coated tires 6 and drive cogwheels 8, has connection with the attachable section 31 of an H-shaped rail.

Figure 1:
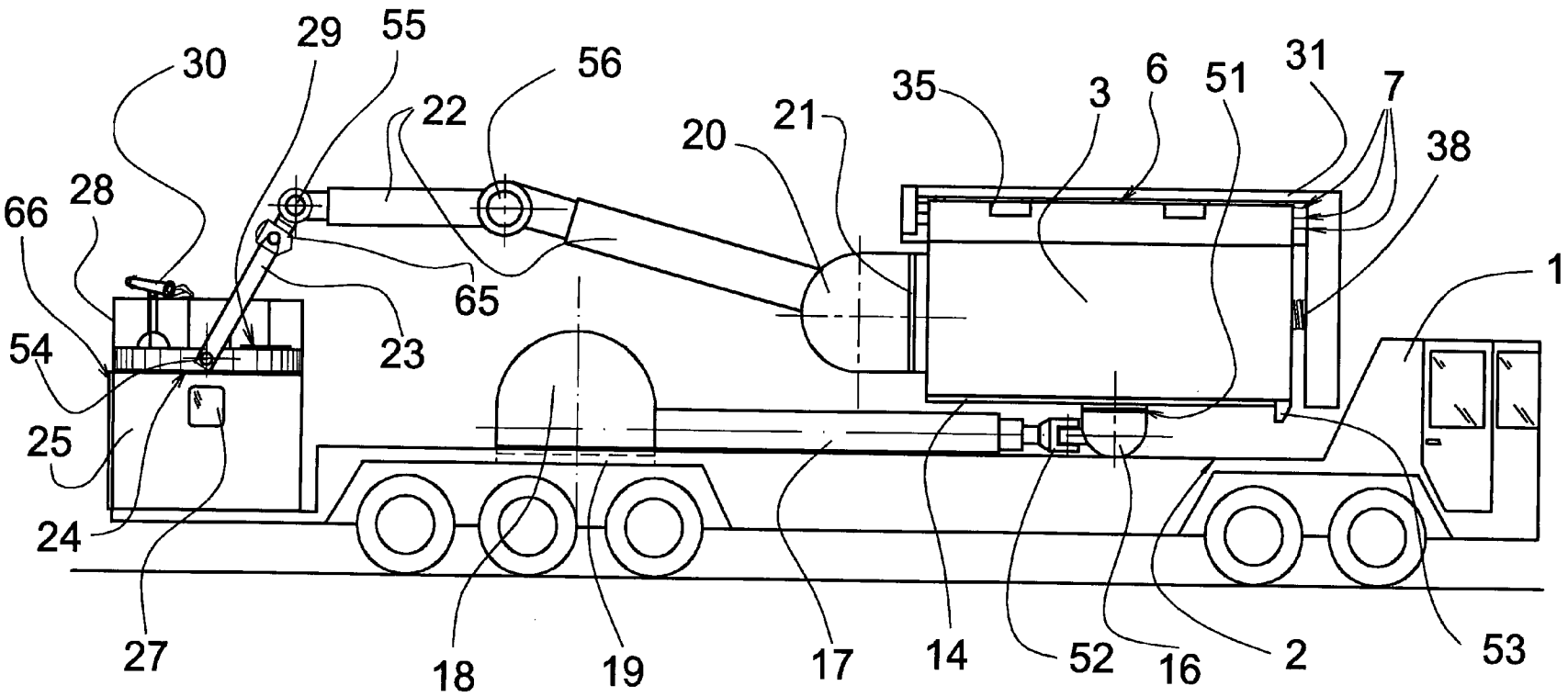
FIG. 1 shows a side view of the invention on a vehicle.
Figure 2:
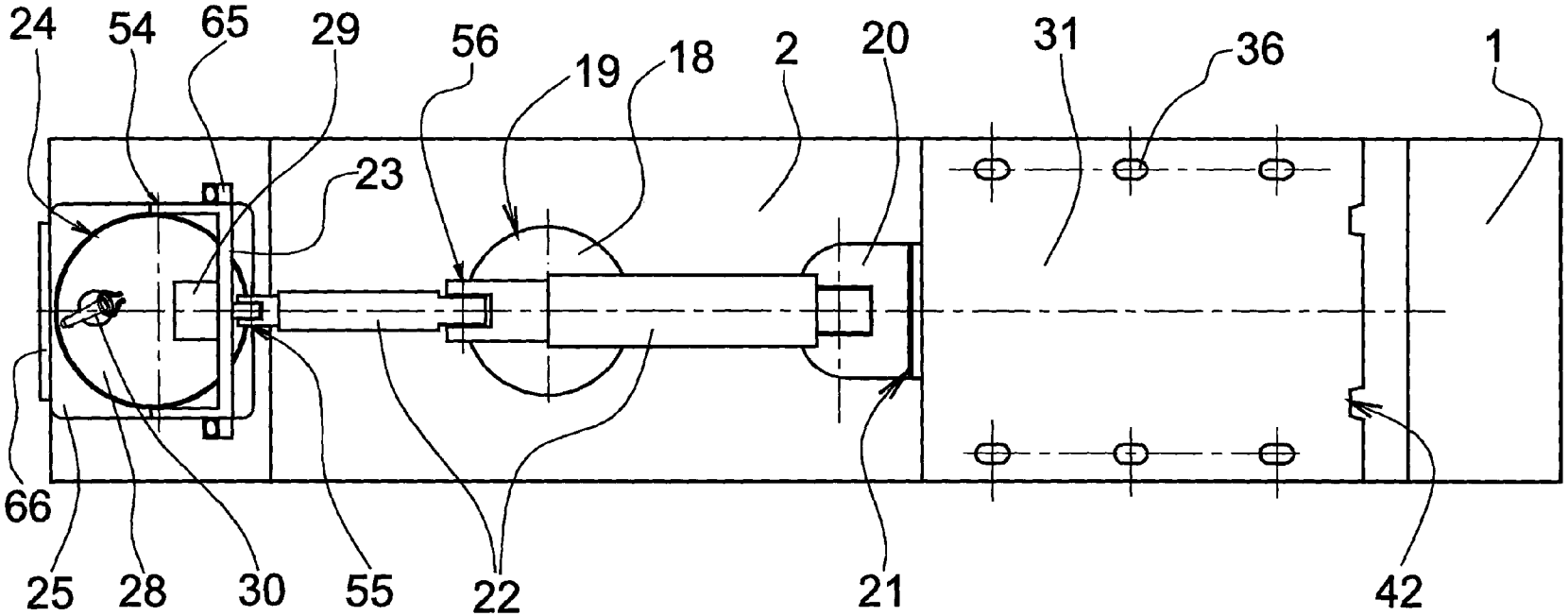
FIG. 2 shows a top view of the invention on a vehicle.

The elevator portion 3 with the attachable section 31 of an H-shaped rail, as well as the whole attachable structure with the telescopic arm 22 and the cabin 25, is mounted on the chassis 1, as shown in the FIGS. 1 and 2. In case the elevator portion isn't in work, it is to be kept in such position in a special hangar (fire depot). When the depot gets a fire alarm, the chassis 1 being kept on the top surface 2 together with the elevator portion 3, is delivered to the building on fire immediately.

Figure 6:
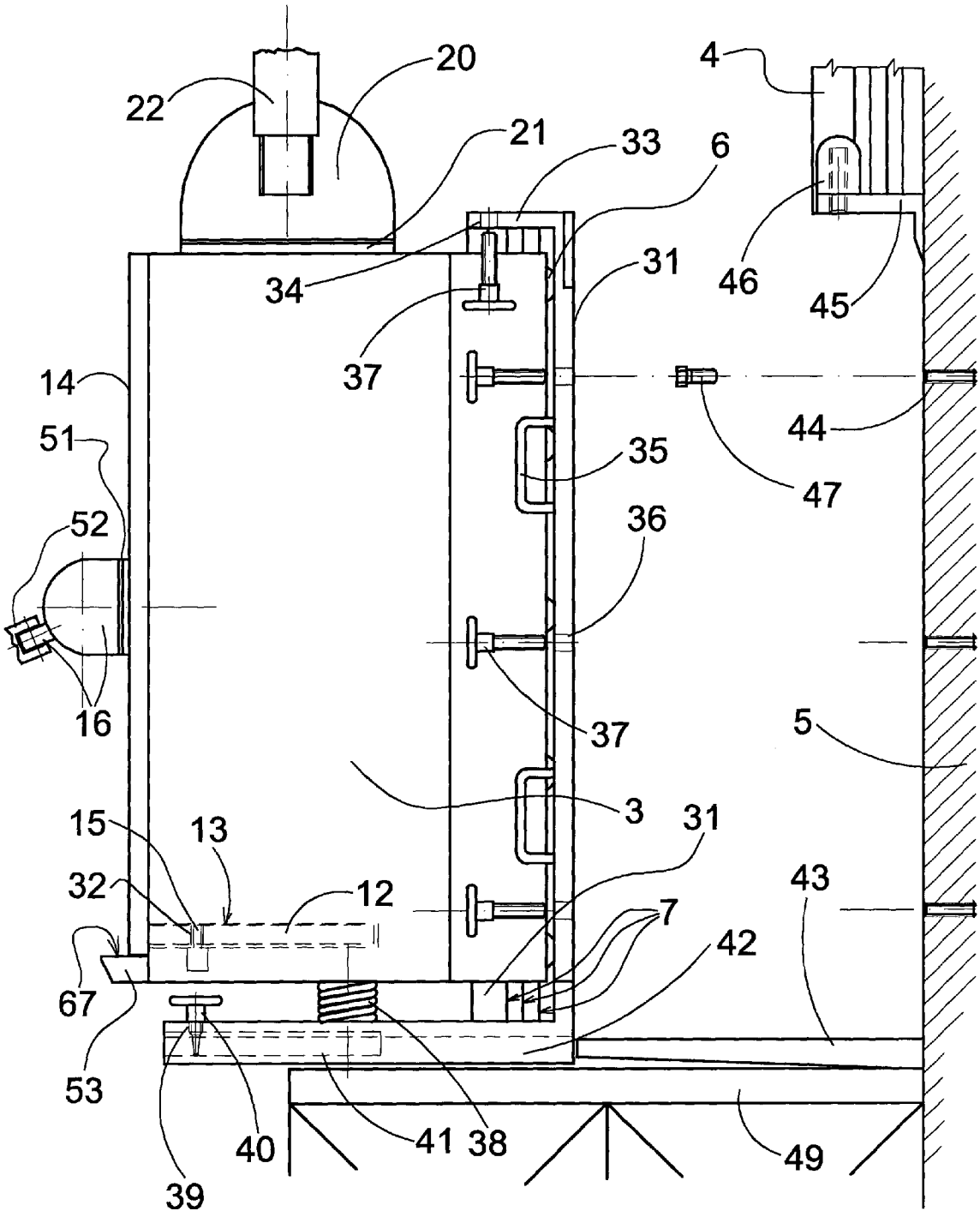
FIG. 6 shows a side view of the attachment section of an H-shaped rail.
Figure 7:
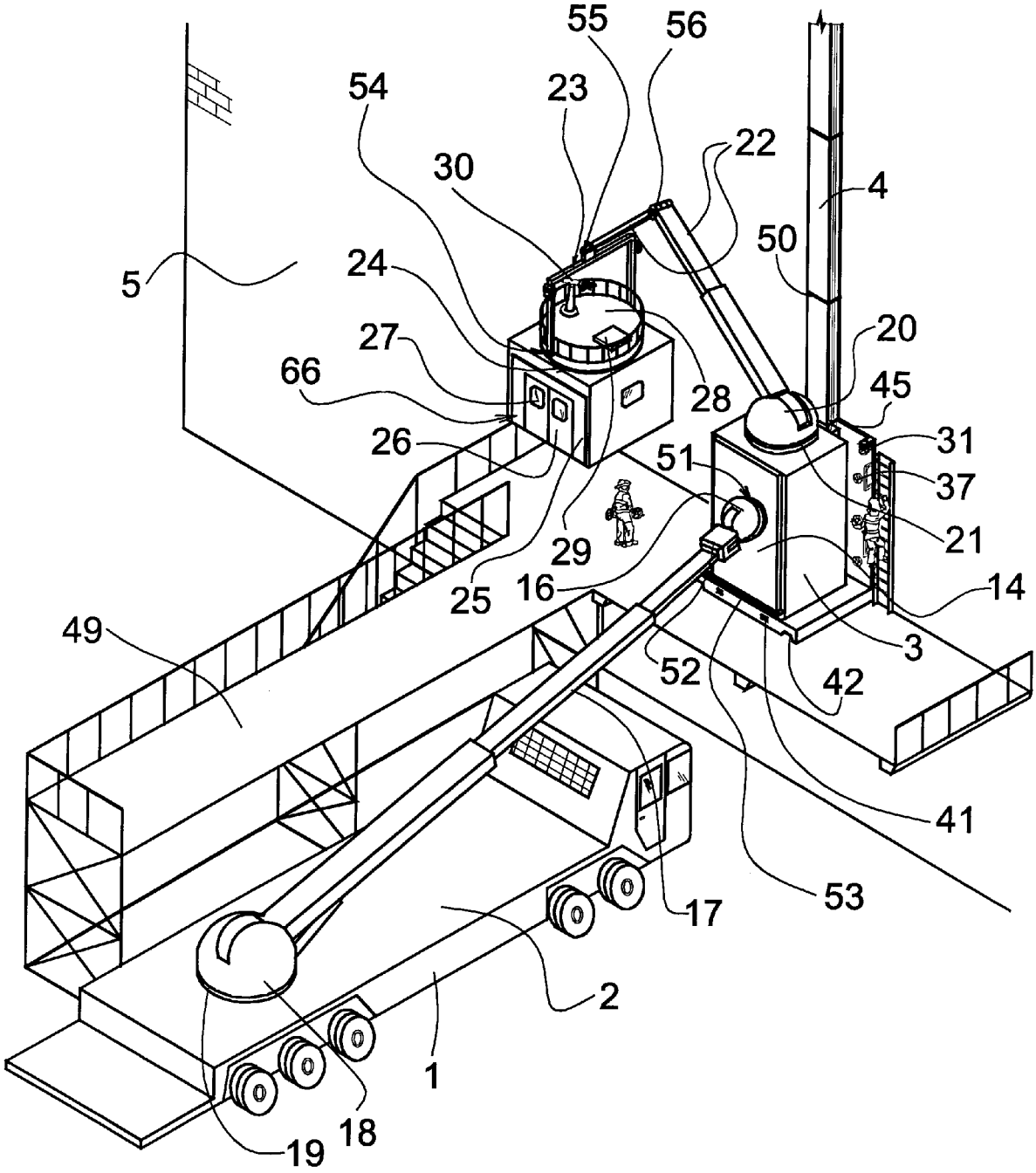
FIG. 7 shows a perspective view of the elevator portion being installed onto an H-shaped rail.

As shown in FIG. 7, when the chassis is delivered to the building on fire 5, the chassis is placed close to a permanently located on the building H-shaped rail and auxiliary portion 49 of the building. After that, the process of installment of the elevator portion 3 and of attachable section 31 of an H-shaped rail to a building wall starts, as it is shown in FIGS. 6 and 7.

The installment of the elevator portion 3 and of the attachable section of an H-shaped rail to the building wall 5 is as follows:

The telescopic rotating pole 17 is lifted to the level approximately 45 degrees in relation to the top working surface 2 of the car chassis 1. At the moment, a holding bed mechanism 14, due to its vertical pivoting mechanism 16, is kept strictly horizontal.

Then, with the help of a horizontal rotating mechanism 19, the telescopic rotating pole 17 with the holding bed mechanism 14 on which the elevator portion 3 with the attachable section 31 of an H-shaped rail, is turned towards the building 5.

After that, the holding bed mechanism 14, with the help of its vertical pivoting mechanism 16, is rotated 90 degrees to a strictly vertical position.

At the same time, with the help of the pivoting mechanism 20 the first part of the telescopic arm 22 is lowered towards the building 5—approximately 45 degrees in relation with the vertical axis of the elevator portion 3. With the help of the pivoting mechanism 56, the second part of the telescopic arm is lowered approximately 90 degrees in relation with the first part of the telescopic arm 22. With that, the cramp 23 with the help of the vertical rotating mechanism 55, is place into a strictly vertical position. At the same time with the cramp 23, the cabin 25 is aligned into a strictly vertical position by the vertical rotating mechanisms 54.

Then the telescopic rotating pole 17 is being turned towards the building wall 5—until the fork elements 43 of the building 5 touch to the back panel of the attachable section 31 of an H-shaped rail.

Then, with the help of the pivoting mechanism 16 and rotating mechanisms 51 and 52, the position of the holding bed mechanism 14 is being aligned until the guiding slots 42 of the attachable section 31 of an H-shaped rail are placed strictly symmetrical, on all surfaces, in relation with the fork elements 43 of the building 5.

Before that, mounting workers screw out all screw deadeners 47 from the threaded elements 44 in the walls of the building 5.

Then, mounting workers, with the help of hand-rails 35, make hand correction of the attachable section 31 of the H-shaped rail—until all outer ends of the fork elements 43 are placed into the guiding slots 42.

Then, the telescopic rotating pole 17 is being moved until the back panel of the attachable section 31 of the H-shaped rail contacts the building 5.

As a result of that, the fork elements 43 are completely in the guiding slots 42, and the upper part of the attachable section 31 is in the guiding metallic profile 45. Due to that, holes 34 of the corner elements 33 become aligned on a vertical axis with the corner elements 46 of the guiding metallic profile 45.

Mounting workers, then, connect these corner elements 33 with corner threaded elements 46, screwing the screws 37 to full stop: Also, workers screw to full stop the screws 37 through the holes 36 into threaded elements 44 in a building wall 5.

As a result of these mounting operations, the attachable section 31 of the H-shaped rail is:

- installed by its lower part in the vertical plane on the fork elements of the building 5;
- connected by its upper part in the vertical plane with the permanently installed H-shaped rail 4 on the building;
- strictly pressed by its middle part in the horizontal plane to a building wall 5.

The attachable section 31 of the H-shaped rail is a lower ending part of the permanently mounted H-shaped rail 4 on the wall and is completely identical to it.

As a conclusion, the attachable section 31 of the H-shaped rail and the permanently mounted on the building H-shaped rail 4 formed a unified line of an H-shaped rail on the building wall 5.

As the elevator portion 3, and the whole attachable structure (together with the telescopic arm 22 and cabin 25) are permanently mounted on the attachable section 31 of the H-shaped rail, it becomes possible to demount of this attachable structure from the loading-unloading holding bed structure 14.

For this purpose, the holes 32 of the fork elements 12 are freed of jack latches 15 of the elevator portion 3.

Then, by moving the telescopic rotating pole 17, the slots 13, which are located in the body of the elevator portion 3, are freed from fork elements 12 of the holding bed 14.

The loading-unloading holding bed 14, freed after this operation, is rolled up and placed in a transport position on the top surface 2 of the chassis 1. (The demounting operation of the elevator portion 3 and of the attachable section 31 is made by vice versa action).

Drive structure 11, located in the body of the elevator portion 3, is activated and, in its turn, drives into action the driving cog-wheels 8 which, interacting with guiding racks 9 of the guiding slots 10, start moving the elevator portion 3 on the attachable section 31 of the H-shaped rail.

Simultaneously, in the guiding slots 7, wheels 6 start moving, securing stable position of the elevator portion 3 on the H-shaped rail.

Thus, the elevator portion 3 travels from the attachable section 31 of H-shaped rail to the permanently mounted on the building H-shaped rail 4, and can now travel in both directions along the length of the H-shaped line to any high level of the building 5.

Figure 10:
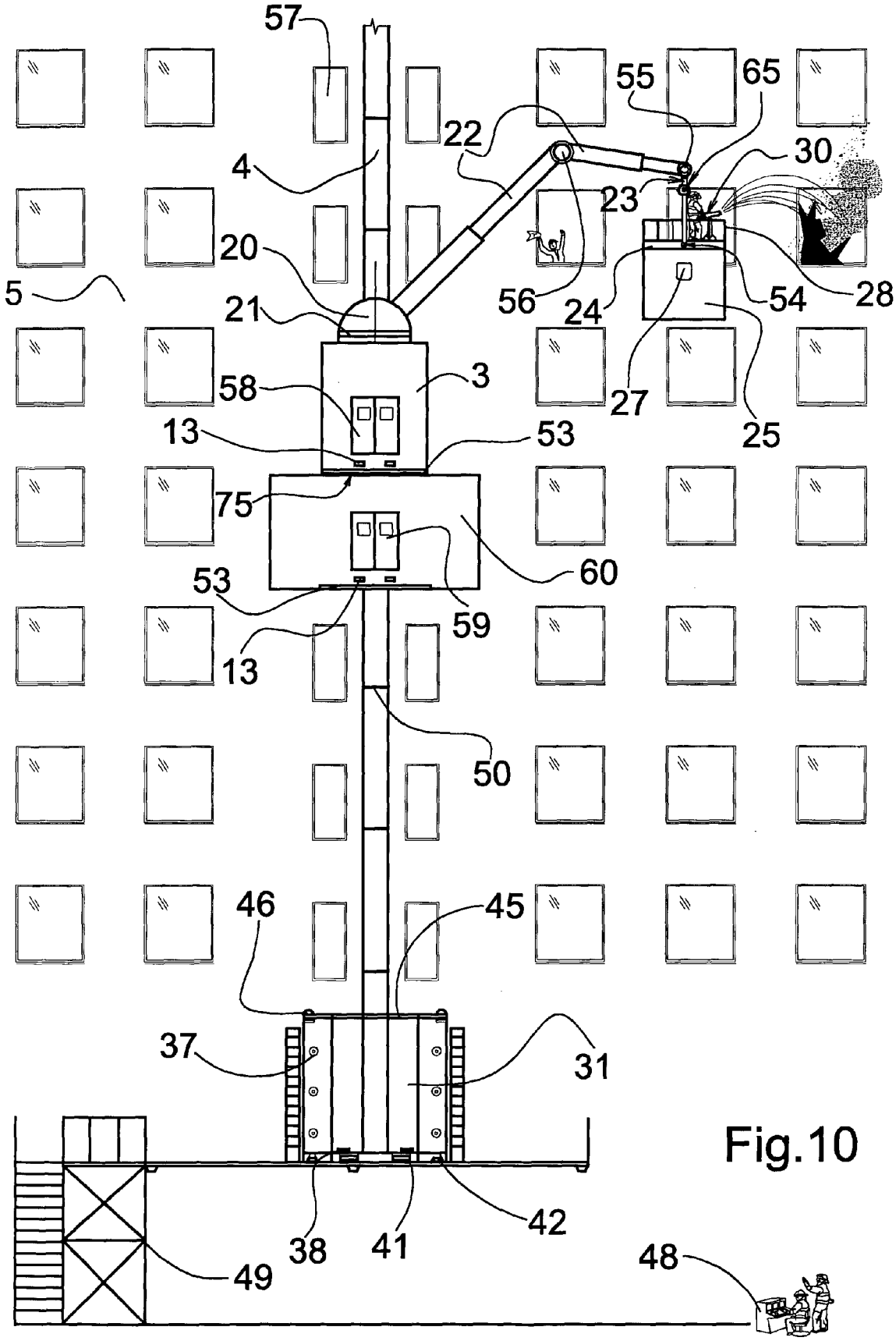
FIG. 10 shows a front view of a building having the elevator and crane system used for fire-fighting and rescue.

Correspondingly, it becomes possible to move immediately the elevator portion 3 to that dangerous (on fire) floor level of the building 5, and to start fire-fighting operations with the help of a fire/foam pipe 30 mounted on the outside surface 28 with a barrier of the cabin 25—as it is shown in the FIG. 10.

Simultaneously with the elevator portion 3 lifting to the dangerous level/floor, mounting of an autonomous rescue elevator 60 is started.

To ensure the possibility of such operation, first, the disconnected attachable section 31 of the H-shaped rail, is demounted. This is done in the following consequence:

The telescopic rotating pole is lifted to a level approximately 45 degrees in relation to the top working surface 2 of the car chassis 1. At the moment, a holding bed mechanism 14, due to its vertical pivoting mechanism 16, is kept strictly horizontal. Then, with the help of a horizontal rotating mechanism 19, the telescopic rotating pole 17 with the holding bed mechanism 14, is turned towards the building 5. After that, the holding bed mechanism 14, with the help of its vertical pivoting mechanism 16, is rotated 90 degrees to a strictly vertical position.

Then, the telescopic rotating pole 17 is being turned towards the building wall 5—until the fork elements 12 are positioned closely to the slots 41, which are located in the lower part of the attachable section 31 of the H-shaped rail.

The, with the help of the pivoting mechanism 16 and rotating mechanisms 51 and 52, the position of the holding bed mechanism 14 is being aligned until the guiding slots 41 of the attachable section 31 of the H-shaped rail are placed strictly symmetrical, on all surfaces, in relation with the fork elements 12 of the holding bed mechanism 14.

Then the telescopic rotating pole 17 is being moved until the fork elements 12 are completely placed into the guiding slots 41 of the attachable section 31 of the H-shaped rail.

Montage workers screw and take out the screws 37 from the threaded elements 44 in a building wall 5, and also, from the corner elements 46 of the guiding metallic profile 45.

After that, the attachable section 31 of the H-shaped rail is completely disconnected from a building wall 5.

With the help of the telescopic rotating pole 17, this attachable section 31 of the H-shaped rail is taken from the fork elements 43 and lowered down to the ground level—closely to the auxiliary portion 49 of the building 5—for temporary keeping in reserve. That's because just this attachable section 31 of the H-shaped rail will be needed, later, for demounting of the elevator portion 3.

Now, it becomes possible to install, to the free area of the building wall 5, another attachable section 31 of the H-shaped rail, connected with the autonomous rescue elevator 60.

For this, the chassis 1 travels from the auxiliary part of the building 49; which chassis 1 delivers elevator portion 3 to the building 5, thus making the surface vacant for another chassis 1 which has an autonomous rescue elevator 60.

After the parking of the chassis 1 with the autonomous rescue elevator 60 is completed on the vacant surface at the auxiliary part of the building 49, the rescue elevator 60 is being mounted to the building 5.

The autonomous rescue elevator 60, like the elevator portion 3, has connection to the attachable section 31 of the H-shaped rail though the elastic tire wheels 6 and drive cog-wheels 8.

The chassis 1 to which the autonomous rescue elevator 60 was delivered (to building 5), has the same loading-unloading mechanism, as on the previous chassis 1 with the elevator portion 3 delivered (with the rotating mechanisms 18, 19, 52, 16, 51), and with telescopic pole 17 and holding bed 14.

In view of this, the sequence of mounting operations for the rescue elevator 60 to building 5 (as well as demounting ones) is the same as with the elevator portion 3. After the autonomous rescue elevator 60 is installed on the H-shaped rail, it is being lifted after the elevator portion 3 to the building level on fire.

While the elevator portion 3 is already on the required level and it starts fire-fighting with its own fire/foam pipe 30 installed on the outside surface 28 with the barrier.

Simultaneously with fire-fighting operations, the cabin 25 of the elevator portion 3 can start evacuating people which can't use fire staircases and escape exits. For this purpose, the cabin is transported to a window embrasure of the building 5 where people are located.

Then, safe junction of the cabin 25 surface with sliding doors to the window embrasure is made with the help of an elastic profile element 66 along the perimeter of the sliding doors 26.

Next, the sliding doors 26 are opened, and the people escape from the dangerous building 5 through the window embrasure to the cabin 25.

By that moment, the autonomous rescue elevator 60 came up to the level of a dangerous floor and aligned with the lower surface of the elevator portion 3—with the help of its elastic profile element 75 mounted on the upper surface of the elevator.

The cabin 25 with evacuated people is transported to the outside surface of the autonomous rescue elevator 60 with sliding doors 59 supplied with fireproof glasses 2.

Then, as it shown on the FIG. 9, the surface of the cabin 25 with sliding doors 26 is aligned with the outside surface of the autonomous rescue elevator 60 with the sliding doors 59.

Close and safe fitting of the cabin 25 to the autonomous rescue elevator 60 is made with the help of an elastic profile element 66 along the outer perimeter of the sliding doors 26 of the cabin 25, and also with the help of supporting elements 53 (of the autonomous rescue elevator 60) supplied with elastic gaskets 67 on upper surfaces.

Next, the sliding doors 26 of the cabin 25 and the sliding doors 59 of the autonomous rescue elevator 60 are opened and the people leave the cabin 25 for the autonomous rescue elevator 60.

Then, all these sliding doors are closed; the cabin 25 disconnects from the autonomous rescue elevator 60 and comes back to the dangerous level of the building 5, and the autonomous rescue elevator 60 transports the people down—to the auxiliary part of the building 49.

Such operations are to be continued until all the people from the dangerous level are evacuated.

The present invention also allows a speeded evacuation of people from a dangerous level of the building. Its is especially important when there are many people on the dangerous level or if that level is very high.

Such possibility is realized by:

Variant A a passenger compartment 68 of the elevator portion 3, which outside surface is supplied with sliding doors 58 equipped with fireproof glass windows 27.

Variant B emergency exits 57 of the building located on each floor of the building 5—symmetrical to the vertical axis of the sliding doors 76 of the autonomous rescue elevator 60.

Variant A—Passenger compartment 68 of the elevator portion 3 which is put into action when the cabin 25 is full and the autonomous rescue elevator 60 hasn't returned to the elevator portion 3 to pick up a new group pf evacuated people; in such case, the cabin 25 with evacuated people is transported and aligned to the passenger compartment 68 of the elevator portion 3—as shown in the FIG. 8.

Close and safe fitting of the cabin 25 to the surface of the passenger compartment 68 of the elevator portion 3 is fulfilled with the help of elastic profile element 66 installed along the outer perimeter of the sliding doors 26 of the cabin 25, and also with the help of supporting elements 53 (of the elevator portion 3) which contain their upper surfaces elastic gaskets 67.

Then, the sliding doors 26 of the cabin 25 and the sliding doors 58 of the passenger compartment 68 of the elevator portion 3 are opened, people leave the cabin 25 for passenger compartment 68. All these doors are the closed, the cabin 25 disconnects from the passenger compartment 68 and comes back to the dangerous level of the building 5—to pick up a new group of evacuated people.

By that time, the autonomous rescue elevator has already traveled from the auxiliary part of the building 49 (where it unloaded the evacuated people) to the elevator portion 3 and aligned with it.

After this alignment is completed, a hatch 69 of the passenger compartment 68 and a hatch 73 of the autonomous rescue elevator are opened, and people go down from the passenger compartment 68 to the autonomous rescue elevator 60—through the vertical embrasure 70 on the staircase 71.

As the capacity of the autonomous rescue elevator 60 is several times more than of the cabin 25, it is possible, at the same time, to align the cabin 25 with the autonomous rescue elevator 60 and to make a transfer of another group of evacuated people from the cabin to the elevator.

As a consequence of the above-described actions, the cabin 25 will be always in work, without waste of time, helping to timely evacuation of people from the dangerous level.

Variant B—Emergency exits 57 of the building will be put into action when some part of the building located below the dangerous level may be used fro evacuation of people—if the staircases there are not under fire or smoke, and if they are not destroyed. In such case, the autonomous rescue elevator doesn't have to go down to the lowest level of the building 5—to the auxiliary part (especially if it is a high-rise building).

In such cases, to save time, the autonomous rescue elevator 60 with a group of evacuated people is lowered to a safe level of the building.

There the rescue elevator will stop, and the sliding doors 76 of this elevator will be aligned with the evacuation exit of this floor (level).

The sliding doors 76 of the autonomous rescue elevator 60 and the door of the emergency exit 57 of the building are opened, and people leave the rescue elevator 60 to enter inside the building. Now, inside the building this group of evacuated people walk down on the interior emergency staircases, and the autonomous rescue elevator goes up to pick up a new group of evacuated people.

The elevator portion 3 and the whole attachable structure (with the telescopic arm 22 and the cabin 25), as well as the autonomous rescue elevator 60 can be controlled by personnel—both from inside, with the help of control panels 63, and from outside—with the help of remote controls 48.

The elevator portion 3 and the whole attachable structure (with the telescopic arm 22 and with the cabin 25) and the autonomous rescue elevator 60 have a hermetic thermo-insulating outer coating.

The elevator portion 3 and the whole attachable structure (with the telescopic arm 22 and with cabin 25) and the autonomous rescue elevator 60 are provided with telemetric equipment (temperature, distance control and pollution sensors, camcorders, long-distance lighting (searchlight projector 65), speakers and radio).

The elevator portion 3, cabin 25 and the autonomous rescue elevator 60 have compartments 62 for auxiliary equipment, compartments 61 for keeping fire-fighting materials—foam, water and oxygen, and also terminals 72 and supplying hoses 74.

The elevator portion 3, cabin 25 and the autonomous rescue elevator 60 are supplied with batteries and terminals for charging them.

To ensure safe and effective work of fire-fighting personnel on any level, the cabin 25 is provided with an outside surface 28 with a barrier, fire-pump 30, hatch 29 and staircase 64.

The elevator portion 3, cabin 25 and the autonomous rescue elevator 60 are equipped with hermetically closed sliding doors (accordingly, 58, 26, 59 and 76) and with fire-proof glass windows 27.

The passenger compartment 68 of the elevator portion 3, cabin 25 and the autonomous rescue elevator 60 are provided with cleaning and air-conditioning systems, and with oxygen masks and set of medicines for emergency medical help.

The H-shaped rail may be supplied with illumination means—to ensure visual control of the whole line during nighttime.

To avoid overheating of the H-shaped rail 4 during the fire (and, accordingly, possible deformation), thermo-insulating sections 50 (made, e.g. of asbestos materials) are mounted on the rail surface (at equal distances and without affecting its contour).

What is claimed is:

1. An elevator system attached to the outside of a building comprising, an elevator portion having a rail engaging portion for moving the elevator portion vertically on a rail attached to a structure, a crane portion attached to the elevator portion, the crane portion having a rotating mechanism and a pivoting mechanism supporting one end of a telescopic arm, the telescopic arm having at its other end a pivoting mechanism attached to a cramp by a vertical rotating mechanism that supports an outside platform with a barrier and a cabin hung from the outside platform by a rotating connection for reaching any position on or above a building.

2. An elevator system attached to the outside of a building as in claim 1 wherein, the elevator nortion has a passenger compartment having a control panel.

3. An elevator system attached to the outside of a building as in claim 1 wherein, a working surface of a rail has a guiding slot.

4. An elevator system attached to the outside of a building comprising, an elevator portion having a rail engaging portion for moving the elevator portion vertically on a rail attached to a structure, a crane portion attached to the elevator portion, the crane portion having a rotating mechanism and a pivoting mechanism for supporting one end of a telescopic arm, the telescopic arm having a platform at the other end for reaching any position on or above a building, the elevator portion provided with a passenger compartment, an autonomous rescue elevator on the rail, an aperture in the floor of the elevator portion and an aperture in the ceiling of the autonomous rescue elevator for alignment with the aperture in the elevator portion to transfer passengers therebetween.

5. An elevator system attached to the outside of a building as in claim 4 wherein, elastic elements are provided on lower contact surfaces of the elevator portion and the autonomous rescue elevator has supporting elements for connecting the elevator portion and the autonomous rescue elevator.

6. An elevator system attached to the outside of a building as in claim 4 wherein, the elevator portion and the autonomous rescue elevator have a compartment for keeping anti-fire foam, liquids, hoses and other auxiliary equipment for constant additional fuelling and liquids supply.

7. An elevator system attached to the outside of a building as in claim 4 wherein, the telescopic arm has two parts interconnected with a pivoting mechanism attached at its end to a cramp by a vertical rotating mechanism.

8. An elevator system attached to the outside of a building as in claim 7 wherein, the cramp has an outside platform with a barrier.

9. An elevator system attached to the outside of a building as in claim 8 wherein, a cabin hung from the outside platform by a rotating connection.

10. An elevator system attached to the outside of a building as in claim 4 wherein, the elevator portion has a passenger compartment having a control panel.

11. An elevator system attached to the outside of a building as in claim 4 wherein, a working surface of a rail has a guiding slot.

* * * * *

UNITED STATES PATENT AND TRADEMARK OFFICE

CERTIFICATE OF CORRECTION

PATENT NO. : 7,165,650 B2
APPLICATION NO. : 10/663260
DATED : January 23, 2007
INVENTOR(S) : Pavel V. Korchagin et al.

It is certified that error appears in the above-identified patent and that said Letters Patent is hereby corrected as shown below:

Column 8, line 66, claim 2 please delete “nortion” and insert --portion--.

Signed and Sealed this

Fifth Day of February, 2008

JON W. DUDAS
*Director of the United States Patent and Trademark Office*